US010816226B2

(12) United States Patent
Tomomura et al.

(10) Patent No.: US 10,816,226 B2
(45) Date of Patent: Oct. 27, 2020

(54) CEILING-CONCEALED AIR-CONDITIONING APPARATUS

(71) Applicant: Mitsubishi Electric Corporation, Tokyo (JP)

(72) Inventors: Keisuke Tomomura, Tokyo (JP); Tetsuya Tazawa, Tokyo (JP); Hironobu Suehiro, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1 day.

(21) Appl. No.: 16/323,940

(22) PCT Filed: Nov. 7, 2016

(86) PCT No.: PCT/JP2016/082917
§ 371 (c)(1),
(2) Date: Feb. 7, 2019

(87) PCT Pub. No.: WO2018/083791
PCT Pub. Date: May 11, 2018

(65) Prior Publication Data

US 2019/0249883 A1 Aug. 15, 2019

(51) Int. Cl.
*F28F 19/00* (2006.01)
*F24F 1/0047* (2019.01)
(Continued)

(52) U.S. Cl.
CPC ..... *F24F 1/0047* (2019.02); *F24F 11/58* (2018.01); *F24F 11/89* (2018.01); *F24F 13/082* (2013.01);
(Continued)

(58) Field of Classification Search
CPC ..... F24F 1/0047; F24F 11/89; F24F 11/58; F24F 13/082; F24F 13/20; F24F 2013/207
(Continued)

(56) References Cited

U.S. PATENT DOCUMENTS 5,787,717 A * 8/1998 Bang ..... F24F 1/0007 62/89
2002/0177400 A1* 11/2002 Asahina ..... F24F 1/0047 454/233
(Continued)

FOREIGN PATENT DOCUMENTS

EP 2 980 503 A1 2/2016
JP S61-295452 A 12/1986
(Continued)

OTHER PUBLICATIONS

Extended European Search Report dated Jul. 12, 2018 in the corresponding European Patent Application No. 16908355.7.

*Primary Examiner* — Davis D Hwu
(74) *Attorney, Agent, or Firm* — Posz Law Group, PLC

(57) ABSTRACT

Provided is a ceiling-concealed air-conditioning apparatus, including: an air-conditioning apparatus main body having an air inlet formed in a lower portion thereof; an electrical component box arranged on a side of the air-conditioning apparatus main body, and includes a switch configured to operate the air-conditioning apparatus main body, and arranged on a lower portion of the electrical component box; and a decorative panel arranged below the air-conditioning apparatus main body and the electrical component box to serve as a decorative surface, the decorative panel including: a suction grille arranged so as to be openable and closable and configured to cover the air inlet; and a side panel arranged below the electrical component box, the side panel including an openable and closable cover arranged so as to
(Continued)

be openable and closable and configured to cover the switch when the openable and closable cover is closed, the openable and closable cover including a protruding portion protruded on a side portion of the openable and closable cover on the suction grille side, in which the openable and closable cover is opened by pulling the protruding portion downward under a state in which the openable and closable cover is closed, and in which the protruding portion is covered by the suction grille when the suction grille is closed, and the protruding portion is exposed to an outside when the suction grille is opened.

6 Claims, 4 Drawing Sheets

(51) Int. Cl.

| | |
|---|---|
| ***F24F 13/20*** | (2006.01) |
| ***F24F 11/58*** | (2018.01) |
| ***F24F 11/89*** | (2018.01) |
| ***F24F 13/08*** | (2006.01) |

(52) U.S. Cl.
CPC ..... *F24F 13/20* (2013.01); *F24F 2013/207* (2013.01)

(58) Field of Classification Search
USPC ..... 165/11.1
See application file for complete search history.

(56) References Cited

U.S. PATENT DOCUMENTS

| | | | | |
|---|---|---|---|---|
| 2011/0048050 | A1* | 3/2011 | Moteki ..... | F24F 1/0057 62/263 |
| 2011/0240255 | A1* | 10/2011 | Sakashita ..... | F24F 1/0007 165/53 |
| 2012/0180665 | A1* | 7/2012 | Jeong ..... | F24F 1/0047 95/282 |

FOREIGN PATENT DOCUMENTS

| | | | |
|---|---|---|---|
| JP | H02-096522 | U | 8/1990 |
| JP | H04-129032 | U | 11/1992 |
| JP | H10-197004 | A | 7/1998 |

* cited by examiner

CEILING-CONCEALED AIR-CONDITIONING APPARATUS

CROSS REFERENCE TO RELATED APPLICATION

This application is a U.S. national stage application of PCT/JP2016/082917 filed on Nov. 7, 2016, the contents of which are incorporated herein by reference.

TECHNICAL FIELD

The present invention relates to a ceiling-concealed air-conditioning apparatus, and more particularly, to an openable and closable cover configured to cover a switch and structured so as to be openable and closable.

BACKGROUND ART

Hitherto, there has been known an air-conditioning apparatus including a lid body configured to cover an operation start/stop switch and arranged on a top surface of the air-conditioning apparatus so as to be openable and closable (for example, see Patent Literature 1).

The operation start/stop switch disclosed in Patent Literature 1 is manipulated by a user every time operation of the air-conditioning apparatus is started or stopped. Accordingly, the lid body configured to cover the operation start/stop switch has easily openable and closable structure.

CITATION LIST

Patent Literature

Patent Literature 1: Japanese Unexamined Patent Application Publication No. Sho 61-295452

SUMMARY OF INVENTION

Technical Problem

In recent years, in an air-conditioning apparatus including a wireless remote controller, operation of the air-conditioning apparatus is started or stopped through manipulation of the wireless remote controller. Accordingly, the air-conditioning apparatus includes an emergency operation switch to be manipulated in an emergency such as loss or breakdown of the wireless remote controller, and is configured to operate the air-conditioning apparatus temporarily. The emergency operation switch is a switch that is not manipulated under normal conditions, but manipulated only in an emergency situation. Thus, the structure that may prevent a user from easily manipulating the emergency operation switch is required. In this context, it is conceivable that the lid body configured to cover the emergency operation switch has such structure that the user is not allowed to easily open and close the lid body for preventing the user from easily manipulating the emergency operation switch. However, there is a problem in that the easily openable and closable structure as disclosed in Patent Literature 1 is not suitable for the lid body configured to cover the emergency operation switch.

The present invention has been made to solve the above-mentioned problem, and has an object to provide a ceiling-concealed air-conditioning apparatus having such structure that prevents the user from easily opening an openable and closable cover.

Solution to Problem

According to one embodiment of the present invention, there is provided a ceiling-concealed air-conditioning apparatus, including: an air-conditioning apparatus main body having an air inlet formed in a lower portion thereof; an electrical component box arranged on a side of the air-conditioning apparatus main body, and includes a switch, the switch being arranged on a lower portion of the electrical component box, and configured to operate the air-conditioning apparatus main body, and; a decorative panel arranged below the air-conditioning apparatus main body and the electrical component box to serve as a decorative surface, the decorative panel including a suction grille arranged so as to be openable and closable, and configured to cover the air inlet; and a side panel arranged below the electrical component box, the side panel including an openable and closable cover arranged so as to be openable and closable, the side panel being configured to cover the switch when the openable and closable cover is closed, the openable and closable cover comprising a protruding portion protruding on a side portion of the openable and closable cover on the suction grille side, wherein the openable and closable cover is configured to open by a pull of the protruding portion downward under a state in which the openable and closable cover is closed, and wherein the protruding portion is covered by the suction grille when the suction grille is closed, and the protruding portion is exposed to an outside when the suction grille is opened.

Advantageous Effects of Invention

According to the ceiling-concealed air-conditioning apparatus of one embodiment of the present invention, unless the suction grille is opened, the user cannot open the openable and closable cover by pulling the protruding portion, and further cannot manipulate the switch. Thus, the ceiling-concealed air-conditioning apparatus has the structure that requires a plurality of manipulations in order to open the openable and closable cover, and prevents the user from easily opening the openable and closable cover. With this structure, it is possible to prevent the user from easily manipulating the switch covered by the openable and closable cover.

DESCRIPTION OF EMBODIMENT

Figure 1:
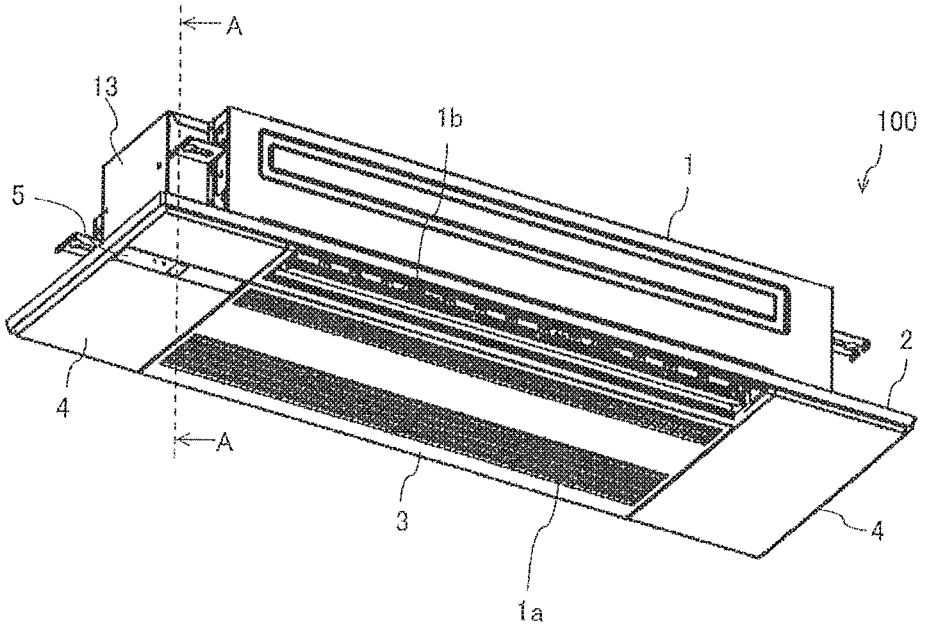
FIG. 1 is a perspective view for illustrating a ceiling-concealed air-conditioning apparatus according to one embodiment of the present invention when seen from a front side thereof.

Now, one embodiment of the present invention is described with reference to the drawings. The present invention is not limited to the one embodiment described below. Moreover, in the drawings referred to below, the size relationship between components may be different from the reality in some cases.

Embodiment

Figure 2:
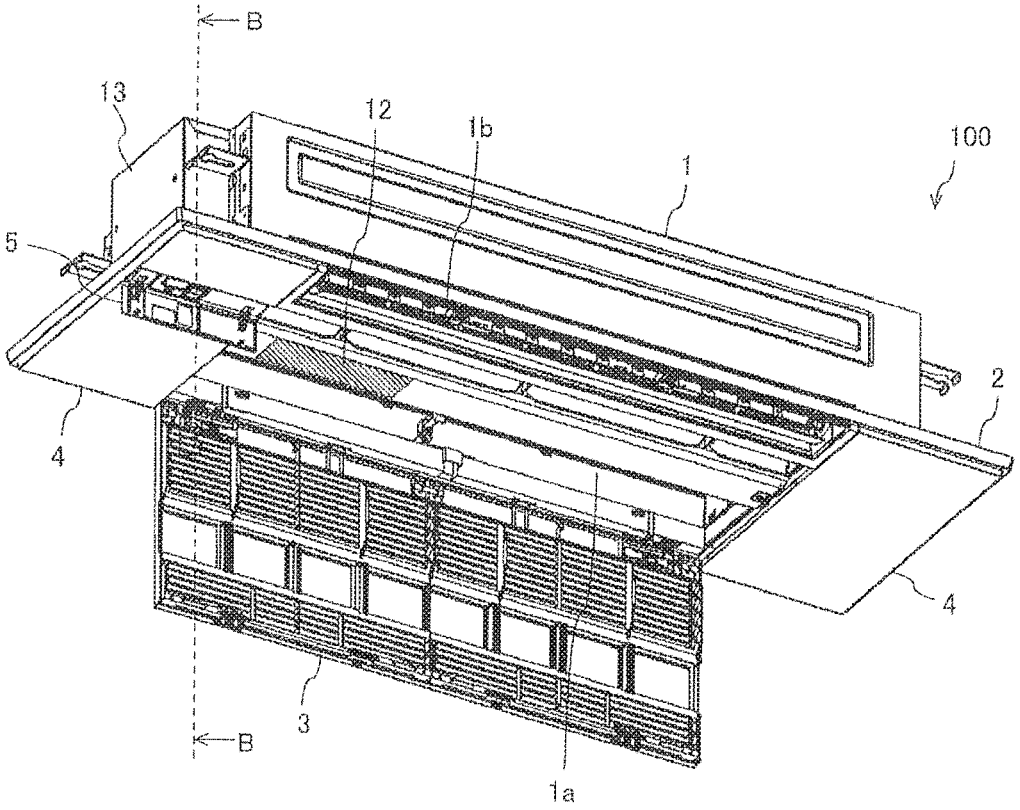
FIG. 2 is a perspective view for illustrating opened states of a suction grille and an openable and closable cover of the ceiling-concealed air-conditioning apparatus according to the one embodiment of the present invention when seen from the front side.
Figure 3:
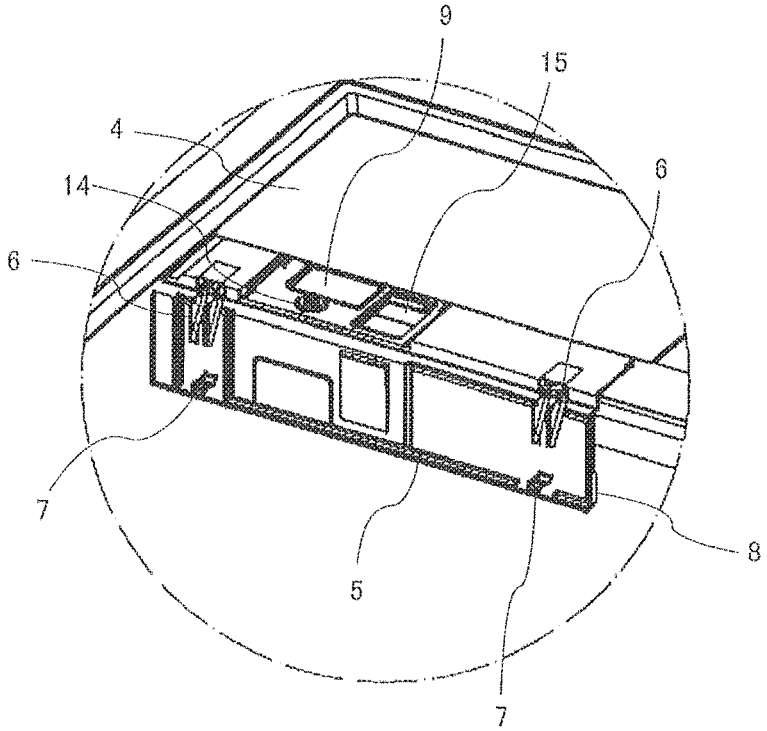
FIG. 3 is an enlarged view for illustrating a periphery of the openable and closable cover of FIG. 2.
Figure 4:
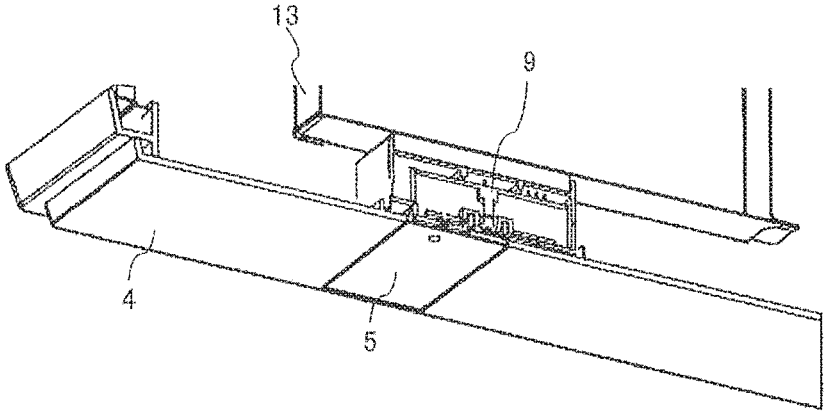
FIG. 4 is a sectional view taken along the line A-A of FIG. 1 when viewed from a direction indicated by the arrows.
Figure 5:
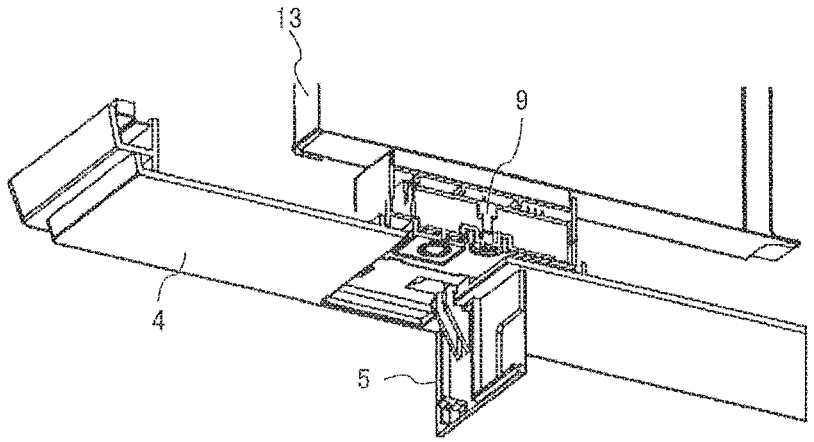
FIG. 5 is a sectional view taken along the line B-B of FIG. 2 when viewed from a direction indicated by the arrows.

FIG. 1 is a perspective view for illustrating a ceiling-concealed air-conditioning apparatus 100 according to the one embodiment of the present invention when seen from a front side thereof. FIG. 2 is a perspective view for illustrating opened states of a suction grille 3 and an openable and closable cover 5 of the ceiling-concealed air-conditioning apparatus 100 according to the one embodiment of the present invention when seen from the front side. FIG. 3 is an enlarged view for illustrating a periphery of the openable and closable cover 5 of FIG. 2. FIG. 4 is a sectional view taken along the line A-A of FIG. 1 when viewed from a direction indicated by the arrows. FIG. 5 is a sectional view taken along the line B-B of FIG. 2 when viewed from a direction indicated by the arrows.

In this embodiment, for ease of understanding, terms representing directions, such as an "upper side", a "lower side", a "right side", a "left side", a "front side", and a "rear side", are used as appropriate. Those terms are used for description, but do not limit the invention of the subject application. Further, in this embodiment, the terms are used to represent the above-mentioned directions under a state in which the ceiling-concealed air-conditioning apparatus 100 is seen from the front side thereof as illustrated in FIG. 1.

The ceiling-concealed air-conditioning apparatus 100 according to this embodiment is installed so as to be concealed in a ceiling. As illustrated in FIG. 1, the ceiling-concealed air-conditioning apparatus 100 includes an air-conditioning apparatus main body 1, which has a box-like shape, and is concealed in the ceiling, an electrical component box 13, which has a box-like shape, and is arranged on a left side of the air-conditioning apparatus main body 1 and concealed in the ceiling, and a decorative panel 2, which has a flat plate-like shape, and is arranged below the air-conditioning apparatus main body 1 and the electrical component box 13 to serve as a decorative surface.

An air inlet 1*a* and an air outlet 1*b* are formed in a lower portion of the air-conditioning apparatus main body 1. Further, an indoor heat exchanger (not shown) and an indoor fan (not shown) are arranged inside the air-conditioning apparatus main body 1.

Now, a flow of air in the ceiling-concealed air-conditioning apparatus 100 according to this embodiment is briefly described.

When indoor air sucked through the air inlet 1*a* passes through the indoor heat exchanger, the indoor air is subjected to heat exchange with refrigerant flowing through an inside of the indoor heat exchanger. At this time, the indoor air is cooled during a cooling operation or heated during a heating operation, and reaches the indoor fan. Then, the conditioned air that has passed through an air duct is blown out through the air outlet 1*b* toward an indoor space.

The decorative panel 2 includes the suction grille 3 arranged at a center portion of the lower portion of the air-conditioning apparatus main body 1 in a right-and-left direction thereof so as to cover the air inlet 1*a*, and side panels 4 arranged on right and left sides of the suction grille 3, respectively.

As illustrated in FIG. 2, the suction grille 3 is configured so as to be openable and closable about a rear end portion thereof as an axis. Further, an operation manual 12 is put on the lower portion of the air-conditioning apparatus main body 1. The operation manual 12 is exposed to the outside when the suction grille 3 is opened.

Further, as illustrated in FIG. 3 to FIG. 5, on a lower portion of the electrical component box 13, there are arranged an emergency operation switch 9 to be manipulated in an emergency, an operation indicator light 14 to be turned on during the operation, and a remote-controller receiving unit 15 configured to receive a signal sent from a wireless remote controller (not shown). Further, the openable and closable cover 5, which is configured to cover the emergency operation switch 9, the operation indicator light 14, and the remote-controller receiving unit 15, is mounted in a openable and closable manner on one of the side panels 4 arranged on the left side of the decorative panel 2 and below the electrical component box 13. In this case, the emergency operation switch 9 is a switch that is not manipulated under normal conditions, but manipulated only in an emergency situation such as loss or breakdown of the wireless remote controller.

The openable and closable cover 5 includes two hook shank portions 6 formed at rear positions on a back surface of the openable and closable cover 5 in a closed state, two claw portions 7 formed at front portions on the back surface of the openable and closable cover 5 in the closed state, and a protruding portion 8 formed on a right side surface of the openable and closable cover 5 on the suction grille 3 side to protrude to the suction grille 3 side.

Figure 6:
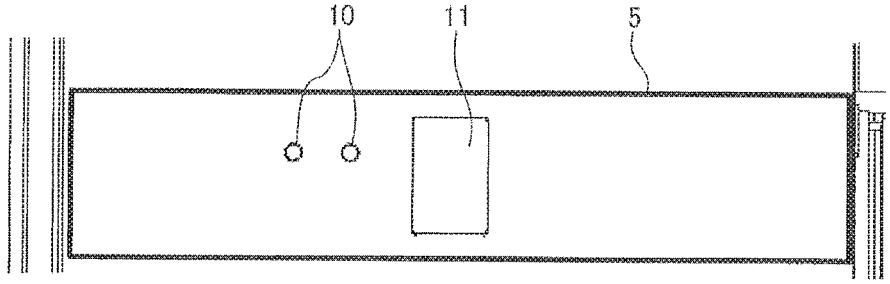
FIG. 6 is a bottom view for illustrating the periphery of the openable and closable cover of the ceiling-concealed air-conditioning apparatus according to the one embodiment of the present invention.

FIG. 6 is a bottom view for illustrating the periphery of the openable and closable cover 5 of the ceiling-concealed air-conditioning apparatus 100 according to the one embodiment of the present invention.

As illustrated in FIG. 6, first transmission windows 10 configured to allow transmission of light of the operation indicator light 14 are formed at positions of the openable and closable cover 5 that are opposed to the operation indicator light 14 under a state in which the openable and closable cover 5 is closed. A second transmission window 11 configured to allow transmission of a signal sent from the wireless remote controller is formed at a position of the openable and closable cover 5 that is opposed to the remote-controller receiving unit 15 under the state in which the openable and closable cover 5 is closed. The first transmission windows 10 and the second transmission window 11, which are displayed on the decorative surface, are formed in the openable and closable cover 5 in this manner so that the first transmission windows 10 and the second transmission window 11 are concentrated at one position. Thus, a good design can be obtained.

Further, electrical components are arranged in the electrical component box 13. The electrical components are arranged in the electrical component box 13 in this manner so that components relevant to the electrical components are concentrated at one position. Thus, reduction of the number of components, arrangement of a substrate, handling of an electric wire, and other operations can be facilitated, thereby being capable of reducing cost.

Figure 7:
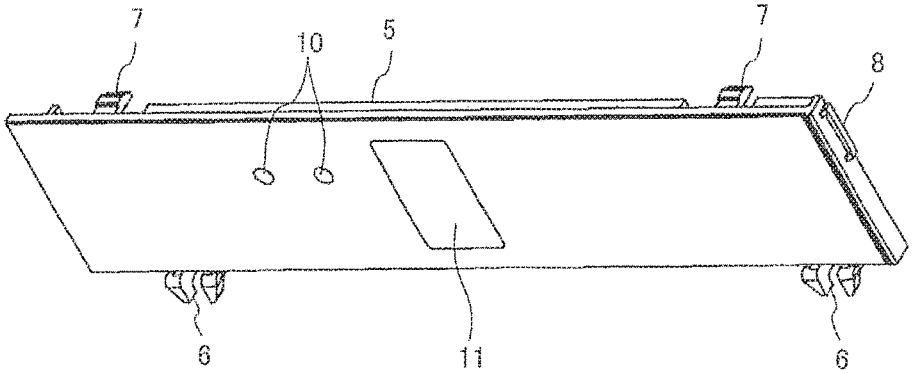
FIG. 7 is a perspective view for illustrating the openable and dosable cover according to the one embodiment of the present invention when seen from a front surface side thereof.
Figure 8A:
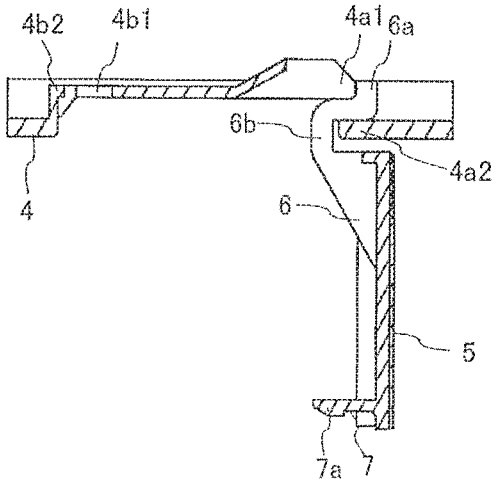
FIG. 8A is a first view for illustrating the structure of mounting the openable and closable cover according to the one embodiment of the present invention to a side panel.
Figure 8B:
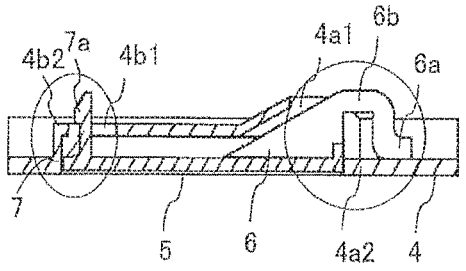
FIG. 8B is a second view for illustrating the structure of mounting the openable and closable cover according to the one embodiment of the present invention to the side panel.

FIG. 7 is a perspective view for illustrating the openable and closable cover 5 according to the one embodiment of the present invention when seen from a front surface side thereof. FIG. 8A is a first view for illustrating the structure of mounting the openable and closable cover 5 according to the one embodiment of the present invention to the side panel 4. FIG. 8B is a second view for illustrating the structure of mounting the openable and closable cover 5 according to the one embodiment of the present invention to the side panel 4.

As illustrated in FIG. 7 and FIG. 8B, each of the hook shank portions 6 of the openable and closable cover 5 includes a distal end portion 6*a* protruding rearward under a state in which the openable and closable cover 5 is closed, and a recess 6*b* recessed to an upper side, which is the electrical component box 13 side, under the state in which the openable and closable cover 5 is closed. Further, each of the claw portions 7 of the openable and closable cover 5 includes a distal end portion 7*a* protruding to the upper side, which is the electrical component box 13 side, under the state in which the openable and closable cover 5 is closed. The openable and closable cover 5 is made of, for example, a resin material.

Further, as illustrated in FIG. 8A and FIG. 8B, a first opening portion 4*a*1 and a second opening portion 4*b*1 are formed in one of the side panels 4. The first opening portion 4*a*1 is formed at a position of the one of the side panels 4 opposed to each of the hook shank portions 6 of the openable and closable cover 5 under the state in which the openable and closable cover 5 is closed. The second opening portion 4*b*1 is formed at a position of the one of the side panels 4 opposed to each of the claw portions 7 of the openable and closable cover 5 under the state in which the openable and closable cover 5 is closed.

As illustrated in FIG. 8A and FIG. 8B, after each of the hook shank portions 6 is bent by pushing the distal end portion 6*a* of each of the hook shank portions 6 of the openable and closable cover 5 into the first opening portion 4*a*1 from a front surface side of the side panel 4, the recess 6*b* of each of the hook shank portions 6 is hooked on a peripheral wall 4*a*2 of the first opening portion 4*a*1. In this manner, the openable and closable cover 5 is supported on the side panel 4 so as to be turnable. Accordingly, the hook shank portions 6 cannot be unhooked from the front surface side of the side panel 4, thereby being capable of preventing falling of the openable and closable cover 5.

When each of the hook shank portions 6 is unhooked from the side panel 4, it is necessary to unhook the recess 6*b* from the peripheral wall 4*a*2 of the first opening portion 4*a*1 while bending each of the hook shank portions 6 by pushing the distal end portion 6*a* of each of the hook shank portions 6 into the claw portion 7 side from a back surface side of the side panel 4 under a state in which the openable and closable cover 5 is opened.

When the openable and closable cover 5 is closed, after each of the claw portions 7 is bent by pushing each of the claw portions 7 of the openable and closable cover 5 into the second opening portion 4*b*1 from the front surface side of the side panel 4 under the state in which the openable and closable cover 5 is opened, the distal end portion 7*a* of each of the claw portions 7 is hooked on a peripheral wall 4*b*2 of the second opening portion 4*b*1. In this manner, the openable and closable cover 5 is fixed to the side panel 4, and the openable and closable cover 5 is kept closed. Further, when the openable and closable cover 5 is opened, after each of the claw portions 7 is bent by a pull of the protruding portion 8 of the openable and closable cover 5 to a lower side opposite to the electrical component box 13 side under the state in which the openable and closable cover 5 is closed, the distal end portion 7*a* of each of the claw portions 7 is unhooked from the peripheral wall 4*b*2 of the second opening portion 4*b*1. In this manner, the openable and closable cover 5 is opened.

The protruding portion 8 of the openable and closable cover 5 is arranged at such a position as to be exposed to the outside under a state in which the suction grille 3 is opened, and to be covered by the suction grille 3 under a state in which the suction grille 3 is closed. That is, under the state in which the suction grille 3 is opened, the protruding portion 8 of the openable and closable cover 5 is exposed to the outside so that the user can touch the protruding portion 8. However, under the state in which the suction grille 3 is closed, the protruding portion 8 is covered by the suction grille 3 so that the user cannot touch the protruding portion 8.

Accordingly, unless the suction grille 3 is opened, the user cannot open the openable and closable cover 5 by pulling the protruding portion 8 downward, and further cannot manipulate the emergency operation switch 9. Thus, the ceiling-concealed air-conditioning apparatus 100 has the structure that requires a plurality of manipulations in order to open the openable and closable cover 5, and prevents the user from easily opening the openable and closable cover 5. With this structure, it is possible to prevent the user from easily manipulating the emergency operation switch 9 covered by the openable and closable cover 5.

In view of the above, the ceiling-concealed air-conditioning apparatus 100 according to this embodiment includes: the air-conditioning apparatus main body 1 having the air inlet 1*a* formed in the lower portion thereof; the electrical component box 13 arranged on a side of the air-conditioning apparatus main body 1, and including the emergency operation switch 9 that is configured to operate the air-conditioning apparatus main body 1 and arranged on the lower portion of the electrical component box 13; and the decorative panel 2 arranged below the air-conditioning apparatus main body 1 and the electrical component box 13 to serve as a decorative surface. The decorative panel 2 includes: the suction grille 3 arranged so as to be openable and closable and configured to cover the air inlet 1*a*; and the side panel 4 arranged below the electrical component box 13. The side panel 4 includes the openable and closable cover 5 arranged so as to be openable and closable and configured to cover the emergency operation switch 9 when the openable and closable cover 5 is closed. The openable and closable cover 5 includes the protruding portion 8 protruded on a side portion of the openable and closable cover 5 on the suction grille 3 side. The openable and closable cover 5 is opened by a pull of the protruding portion 8 downward under the state in which the openable and closable cover 5 is closed. The protruding portion 8 is covered by the suction grille 3 when the suction grille 3 is closed, and the protruding portion 8 is exposed to an outside when the suction grille 3 is opened.

With this configuration, unless the suction grille 3 is opened, the user cannot open the openable and closable cover 5 by pulling the protruding portion 8, and further cannot manipulate the emergency operation switch 9. Thus, the ceiling-concealed air-conditioning apparatus 100 has the structure that requires the plurality of manipulations in order to open the openable and closable cover 5, and prevents the user from easily opening the openable and closable cover 5. With this structure, it is possible to prevent the user from easily manipulating the emergency operation switch 9 covered by the openable and closable cover 5.

Further, the side panel 4 has the first opening portion 4*a*1 formed therein. The openable and closable cover 5 includes the hook shank portion 6 formed on a back surface thereof. The hook shank portion 6 has the recess 6*b* that is recessed upward under the state in which the openable and closable cover 5 is closed. The recess 6*b* of the hook shank portion 6 is hooked on the peripheral wall 4*a*2 of the first opening portion 4*a*1 so that the openable and closable cover 5 is supported by the side panel 4 so as to be turnable.

With this configuration, the hook shank portions 6 cannot be unhooked from the front surface side of the side panel 4, thereby being capable of preventing the falling of the openable and closable cover 5.

Further, the side panel 4 has the second opening portion 4*b*1 formed therein. The openable and closable cover 5 includes the claw portion 7 formed on the back surface thereof. The claw portion 7 includes the distal end portion 7*a* protruded upward under the state in which the openable and closable cover 5 is closed. The openable and closable cover 5 is kept closed in such a manner that the distal end portion 7*a* of the claw portion 7 is hooked on the peripheral wall 4*b*2 of the second opening portion 4*b*1.

With this configuration, without using a component such as a screw, there can be obtained the structure disabling the openable and closable cover 5 from being easily opened and closed.

The ceiling-concealed air-conditioning apparatus further includes the operation manual 12 in which a method of manipulating the emergency operation switch 9 is described. The operation manual 12 is put on the lower portion of the air-conditioning apparatus main body 1, and exposed to the outside when the suction grille 3 is opened.

With this configuration, unless the suction grille 3 is opened, the user cannot read the operation manual 12, and further cannot know a method of manipulating the emergency operation switch 9. Accordingly, the user can be notified of the necessity of opening the suction grille 3 before opening the openable and closable cover 5 when the user intends to manipulate the emergency operation switch 9.

The ceiling-concealed air-conditioning apparatus further includes: the operation indicator light 14 that lights up during operation; and the remote-controller receiving unit 15 configured to receive a signal sent from the wireless remote controller. The operation indicator light 14 and the remote-controller receiving unit 15 are arranged on the lower portion of the electrical component box 13. The openable and closable cover 5 includes: the first transmission window 10, which is configured to allow transmission of light of the operation indicator light 14, and is formed at a position opposed to the operation indicator light 14 under the state in which the openable and closable cover 5 is closed; and the second transmission window 11, which is configured to allow transmission of the signal sent from the wireless remote controller, and is formed at a position opposed to the remote-controller receiving unit 15 under the state in which the openable and closable 5 cover is closed.

With this configuration, the first transmission windows 10 and the second transmission window 11 are concentrated at one position. Thus, a good design can be obtained.

REFERENCE SIGNS LIST

1 air-conditioning apparatus main body
1*a* air inlet
1*b* air outlet
2 decorative panel
3 suction grille
4 side panel
4*a*1 first opening portion
4*a*2 peripheral wall (of first opening portion)
4*b*1 second opening portion
4*b*2 peripheral wall (of second opening portion)
5 openable and closable cover
6 hook shank portion
6*a* distal end portion (of hook shank portion)
6*b* recess
7 claw portion
7*a* distal end portion (of claw portion)
8 protruding portion
9 emergency operation switch
10 first transmission window
11 second transmission window
12 operation manual
13 electrical component box
14 operation indicator light
15 remote-controller receiving unit
100 ceiling-concealed air-conditioning apparatus

The invention claimed is:

1. A ceiling-concealed air-conditioning apparatus, comprising:

an air-conditioning apparatus main body having an air inlet formed in a lower portion thereof;

an electrical component box arranged on a side of the air-conditioning apparatus main body, and includes a switch, the switch being arranged on a lower portion of the electrical component box, and configured to operate the air-conditioning apparatus main body, and;

a decorative panel arranged below the air-conditioning apparatus main body and the electrical component box to serve as a decorative surface, the decorative panel including a suction grille arranged so as to be openable and closable, and configured to cover the air inlet; and a side panel arranged below the electrical component box, the side panel including an openable and closable cover arranged so as to be openable and closable, the side panel being configured to cover the switch when the openable and closable cover is closed, the openable and closable cover comprising a protruding portion protruding on a side portion of the openable and closable cover on the suction grille side, wherein the openable and closable cover is configured to open by a pull of the protruding portion downward under a state in which the openable and closable cover is closed, and wherein the protruding portion is covered by the suction grille when the suction grille is closed, and the protruding portion is exposed to an outside when the suction grille is opened.

2. The ceiling-concealed air-conditioning apparatus of claim 1, wherein the switch includes an emergency operation switch for manipulation in an emergency.

3. The ceiling-concealed air-conditioning apparatus of claim 1, wherein the side panel has a first opening portion formed therein, wherein the openable and closable cover includes a hook shank portion formed on a back surface thereof, wherein the hook shank portion has a recess recessed upward under the state in which the openable and closable cover is closed, and wherein the recess of the hook shank portion is hooked on a peripheral wall of the first opening portion so that the openable and closable cover is supported so as to be turnable.

4. The ceiling-concealed air-conditioning apparatus of claim 1, wherein the side panel has a second opening portion formed therein, wherein the openable and closable cover includes a claw portion formed on the back surface thereof, wherein the claw portion includes a distal end portion protruded upward under the state in which the openable and closable cover is closed, and wherein the distal end portion of the claw portion is hooked on a peripheral wall of the second opening portion so that the openable and closable cover is kept closed.

5. The ceiling-concealed air-conditioning apparatus of claim 1, further comprising an operation manual in which a method of manipulating the switch is described, the operation manual being put on the lower portion of the air-conditioning apparatus main body so as to be exposed to the outside when the suction grille is opened.

6. The ceiling-concealed air-conditioning apparatus of claim 1, further comprising:

an operation indicator light configured to turn on during operation; and a remote-controller receiving unit configured to receive a signal sent from a wireless remote controller, the operation indicator light and the remote-controller receiving unit being arranged on the lower portion of the electrical component box, wherein the openable and closable cover includes a first transmission window configured to allow transmission of light of the operation indicator light, and formed at a position opposed to the operation indicator light under the state in which the openable and closable cover is closed; and a second transmission window configured to allow transmission of the signal sent from the wireless remote controller, and formed at a position opposed to the remote-controller receiving unit under the state in which the openable and closable cover is closed.

* * * * *